US007470072B2

(12) United States Patent
Furihata

(10) Patent No.: US 7,470,072 B2
(45) Date of Patent: Dec. 30, 2008

(54) PLATEN GAP ADJUSTMENT ASSEMBLY, PRINTING APPARATUS AND PRINTER FOR PRINTING TO A PRINT MEDIUM BETWEEN A PLATEN AND A PRINT HEAD

(75) Inventor: Hideki Furihata, Okaya (JP)

(73) Assignee: Seiko Epson Corporation (JP)

( * ) Notice: Subject to any disclaimer, the term of this patent is extended or adjusted under 35 U.S.C. 154(b) by 247 days.

(21) Appl. No.: 11/431,694

(22) Filed: May 9, 2006

(65) Prior Publication Data

US 2006/0257185 A1 Nov. 16, 2006

(30) Foreign Application Priority Data

May 12, 2005 (JP) ..... 2005-139356

(51) Int. Cl.
*B41J 11/20* (2006.01)

(52) U.S. Cl. ..... 400/59; 400/55; 400/355

(58) Field of Classification Search ..... 400/55, 400/59, 60, 354, 355
See application file for complete search history.

(56) References Cited

U.S. PATENT DOCUMENTS 4,883,375 A * 11/1989 Karube et al. ..... 400/55
5,000,590 A * 3/1991 Einem ..... 400/55
5,051,008 A * 9/1991 Honda et al. ..... 400/59
5,322,377 A * 6/1994 Asai ..... 400/55
6,315,468 B2 11/2001 Kishida et al.
6,736,557 B2 * 5/2004 DeVore et al. ..... 400/59

FOREIGN PATENT DOCUMENTS

| | | |
|---|---|---|
| JP | 07-229520 | 8/1995 |
| JP | 08-025721 | 1/1996 |
| JP | 10-211748 | 8/1998 |
| JP | 11-138789 | 5/1999 |
| JP | 2002-067428 | 3/2002 |
| JP | 2002-096521 | 4/2002 |

* cited by examiner

*Primary Examiner*—Ren Yan
(74) *Attorney, Agent, or Firm*—Baker & Hostetler, LLP

(57) ABSTRACT

A platen gap adjustment assembly for a printing apparatus including a printer using the platen gap adjustment assembly to adjust the platen gap between a platen and a print head when printing on a print medium transported between the platen and the print head. The platen gap adjustment assembly includes a guide shaft, which slidably supports a carriage carrying the print head and a pair of mounting members each supporting the guide shaft. The mounting members have positioning engagement parts for holding or maintaining the position of an eccentric shaft in a given position which controls the position of the positioning engagement parts relative to the mounting members. An urging member urges one of the mounting members with the guide shaft fit therein in the direction for causing the positioning engagement parts into one of a given set of positions.

9 Claims, 7 Drawing Sheets

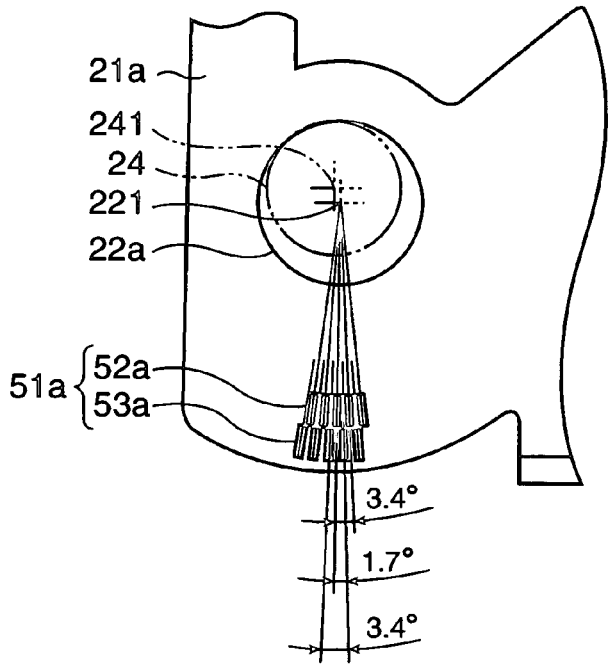
FIG. 8A
FIG. 8B
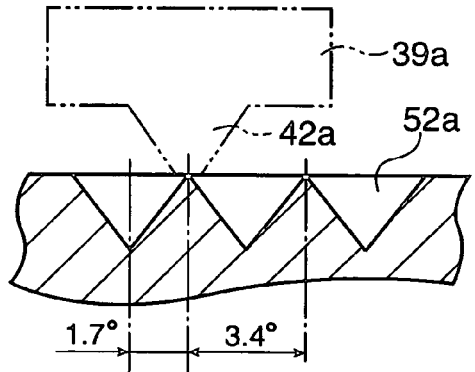
FIG. 8C
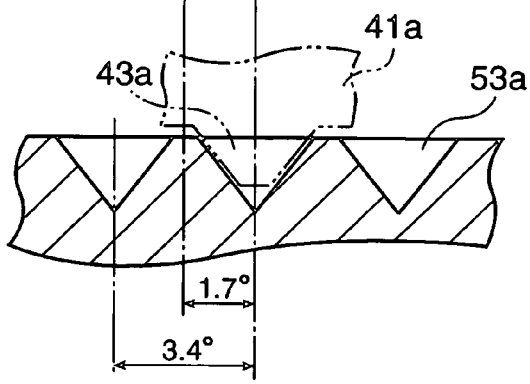

PLATEN GAP ADJUSTMENT ASSEMBLY, PRINTING APPARATUS AND PRINTER FOR PRINTING TO A PRINT MEDIUM BETWEEN A PLATEN AND A PRINT HEAD

BACKGROUND OF THE INVENTION

1. Field of Technology

The present invention relates to a platen gap adjustment assembly for adjusting the platen gap in a printing apparatus between a platen and print head for printing on a print medium transported between the platen and print head and to a printing apparatus including a printer for printing to the print medium. The platen gap is the defined distance between the print head and the platen.

2. Description of Related Art

Some printers use a platen to control the position of the print medium to the print head, position the platen to the print head, and print to a print medium inserted between the platen and print head. The thickness of the print medium may vary according to the application. The appropriate distance between the print head and the print medium also depends upon the printing method. The appropriate platen gap is therefore determined by the thickness of the print medium and the appropriate distance between the print head and print medium. If the thickness range of usable print media is limited to a specific, narrow range, the platen gap can also be set to a fixed distance. However, if the platen gap is fixed when the thickness range of the usable print media is somewhat greater, it may not be possible to maintain the appropriate distance between the print head and the print medium. In this situation the platen gap is first adjusted to a constant default setting, and the platen gap is then changed to the appropriate distance either automatically or manually according to the thickness of the print medium being used.

Japanese Unexamined Patent Appl. Pub. H08-25721 teaches a platen gap adjustment device that works by moving the platen, and Japanese Unexamined Patent Appl. Pub. H10-211748 teaches a platen gap adjustment device that works by moving the print head. Both of these devices use a cam and an eccentric shaft that can rotate on a central axis of rotation, and rotate the cam or the eccentric shaft in order to move the support shaft (control shaft, guide rod) that axially and slidably supports the platen or print head. The cam or eccentric shaft is then stopped at the rotational position yielding the appropriate platen gap, and a shaft-engaging part rendered in unison with the cam or eccentric shaft is then engaged with a frame-engaging part rendered on the printer frame, for example.

The platen gap adjustment device requires a relatively strong force to keep the shaft-engaging part engaged with the frame-engaging part sufficiently to withstand the vibrations accompanying print head movement and the reaction of the print head when printing with a dot impact method. An equal force is also required to overcome this engaging force and disengage the shaft-engaging part from the frame-engaging part in order to rotate the cam or eccentric shaft and adjust the platen gap. In order to thus hold and adjust the platen gap, the device taught in Japanese Unexamined Patent Appl. Pub. H08-25721 renders the engaging parts at a position offset from the center shaft. The length of the lever from the center shaft to the engaging part is thus great enough that a small force is sufficient to disengage the engaging parts. By thus positively securing an engaging part separated from the center shaft, the cam or eccentric shaft can be reliably secured against a large force acting circumferentially to the center shaft.

A problem with locating the engaging parts at a position separated from the center shaft is that the size of the adjustment device comprising the engaging part and the cam or eccentric shaft increases. If the size of the adjustment device increases, the size of the printer incorporating the adjustment device also increases.

An object of the present invention is therefore to provide a platen gap adjustment assembly for a printing apparatus that can adjust the platen gap and maintain a constant platen gap without increasing the size of the platen gap adjustment device. A further object of the invention is to provide a printing apparatus comprising this platen gap adjustment assembly.

SUMMARY OF THE INVENTION

One embodiment of the invention is directed to a platen gap adjustment assembly for a printing apparatus that prints to a print medium between a platen and a print head comprising: a guide shaft for freely slidably supporting a carriage carrying the print head; a first mounting member comprising a first mounting shaft rendered eccentrically to a shaft hole in which the guide shaft is fit, and a first positioning engagement part for positioning; a second mounting member comprising a second mounting shaft rendered eccentrically to a shaft hole in which the guide shaft is fit, a second positioning engagement part for positioning, and a shaft-engaging part for stopping movement of the guide shaft in the axial direction; a frame comprising a mounting hole for accepting the first or second mounting shaft, a plurality of first frame engaging parts for engaging the first positioning engagement part, and a plurality of second frame engaging parts for engaging the second positioning engagement part; and an urging member for urging the first and second positioning engagement parts formed on the first and second mounting members, respectively, and the first and second frame engaging parts formed on the frame together in the engaging direction.

When the first positioning engagement part of the first mounting member urged by the urging member engages the first frame engaging part, the first positioning engagement part is held engaged with the first frame engaging part by the urging force of the urging member in this platen gap adjustment device. Furthermore, when the second positioning engagement part of the second mounting member engages the second frame engaging part as a result of the guide shaft pushed by the urging member pressing against the shaft-engaging part, the second positioning engagement part is held engaged with the second frame engaging part by the urging force of the urging member. The urging force of the urging member thus keeps the first or second positioning engagement part engaged with the first or second frame engaging part, and holds the mounting shaft of the guide shaft desirably positioned in the circumferential direction.

The resistance to deformation of the lever connecting the first or second mounting shaft to the first or second positioning engagement part therefore eliminates the need for a force to keep the positioning engagement part engaged with the frame engaging part. Force to elastically deform the lever connecting the first or second mounting shaft to the first or second positioning engagement part is also unnecessary, thus affording a compact platen gap adjustment device.

According to another aspect of the platen gap adjustment assembly the first mounting member comprises a plurality of first engaging part arms projecting from the first mounting shaft and having the first positioning engagement part rendered on the distal end thereof; the second mounting member comprises a plurality of second engaging part arms projecting from the second mounting shaft and having the second positioning engagement part rendered on the distal end thereof; the frame comprises a plurality of third frame engaging parts for engaging the first positioning engagement part, and a plurality of fourth frame engaging parts for engaging the second positioning engagement part; the third frame engaging part is formed at a position where when the first positioning engagement part formed on one of the first engaging part arms is engaged with one of the third frame engaging parts, the first positioning engagement part formed on the other first engaging part arm is not engaged with the third frame engaging part; and the fourth frame engaging part is formed at a position where when the second positioning engagement part formed on one of the second engaging part arms is engaged with one of the fourth frame engaging parts, the second positioning engagement part formed on the other second engaging part arm is not engaged with the fourth frame engaging part.

Thus comprised, a plurality of third or fourth frame engaging parts can be rendered without increasing the area in the circumferential direction of the shaft of the first or second mounting member.

In yet another embodiment of the platen gap adjustment assembly of the subject invention the length of one first engaging part arm is different from the length of the other first engaging part arm; and the length of one second engaging part arm is different from the length of the other second engaging part arm.

Because the lengths of the plural first and second engaging part arms are different, the first and second positioning engagement parts formed on the first and second engaging part arms, respectively, can be located at different positions radially to the shaft. The area around the circumference of the shaft of the first and second mounting members can thus be reduced when compared with an arrangement in which the first and second positioning engagement parts are arranged around the circumference of the shaft.

In another embodiment of the platen gap adjustment assembly of the subject invention, when the first positioning engagement part formed on one of the first engaging part arms is not engaged with the first frame engaging part, the first positioning engagement part formed on the other first engaging part arm engages one of the third frame engaging parts; and when the first positioning engagement part formed on one of the first engaging part arms is engaged with one of the first frame engaging parts, the first positioning engagement part formed on the other first engaging part arm does not engage the third frame engaging part. Further preferably, when the second positioning engagement part formed on one of the second engaging part arms is not engaged with the second frame engaging part, the second positioning engagement part formed on the other second engaging part arm engages one of the fourth frame engaging parts; and when the second positioning engagement part formed on one of the second engaging part arms is engaged with one of the second frame engaging parts, the second positioning engagement part formed on the other second engaging part arm does not engage the fourth frame engaging part.

The angular interval at which the first or second mounting member can be positioned can thus be reduced by sequentially engaging the first positioning engagement part with either the first or third frame engaging part, and sequentially engaging the second positioning engagement part with either the second or fourth frame engaging part. The platen gap can thus be adjusted in finer increments without increasing the size of the platen gap adjustment device.

The urging member in the platen gap adjustment assembly according to the present invention is preferably a coil spring.

An urging member with a strong urging force can thus be rendered in a confined range by disposing a coil compression spring winding around the guide shaft.

The present invention is also directed to a printing apparatus including a printer, which comprises a platen gap adjustment assembly of reduced size for adjusting and controlling the platen gap.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 8A is a plan view of the side wall through line A-A in FIG. 5.

FIG. 8B is a section view of the inside detent grooves as seen perpendicularly to the longitudinal axis of the inside detent grooves.

FIG. 8C is a section view of the outside detent grooves as seen perpendicularly to the longitudinal axis of the outside detent grooves.

DESCRIPTION OF THE PREFERRED EMBODIMENTS

Preferred embodiments of the printing apparatus 10 including a platen gap adjustment assembly and printer according to the present invention are described below with reference to the accompanying figures.

Figure 1:
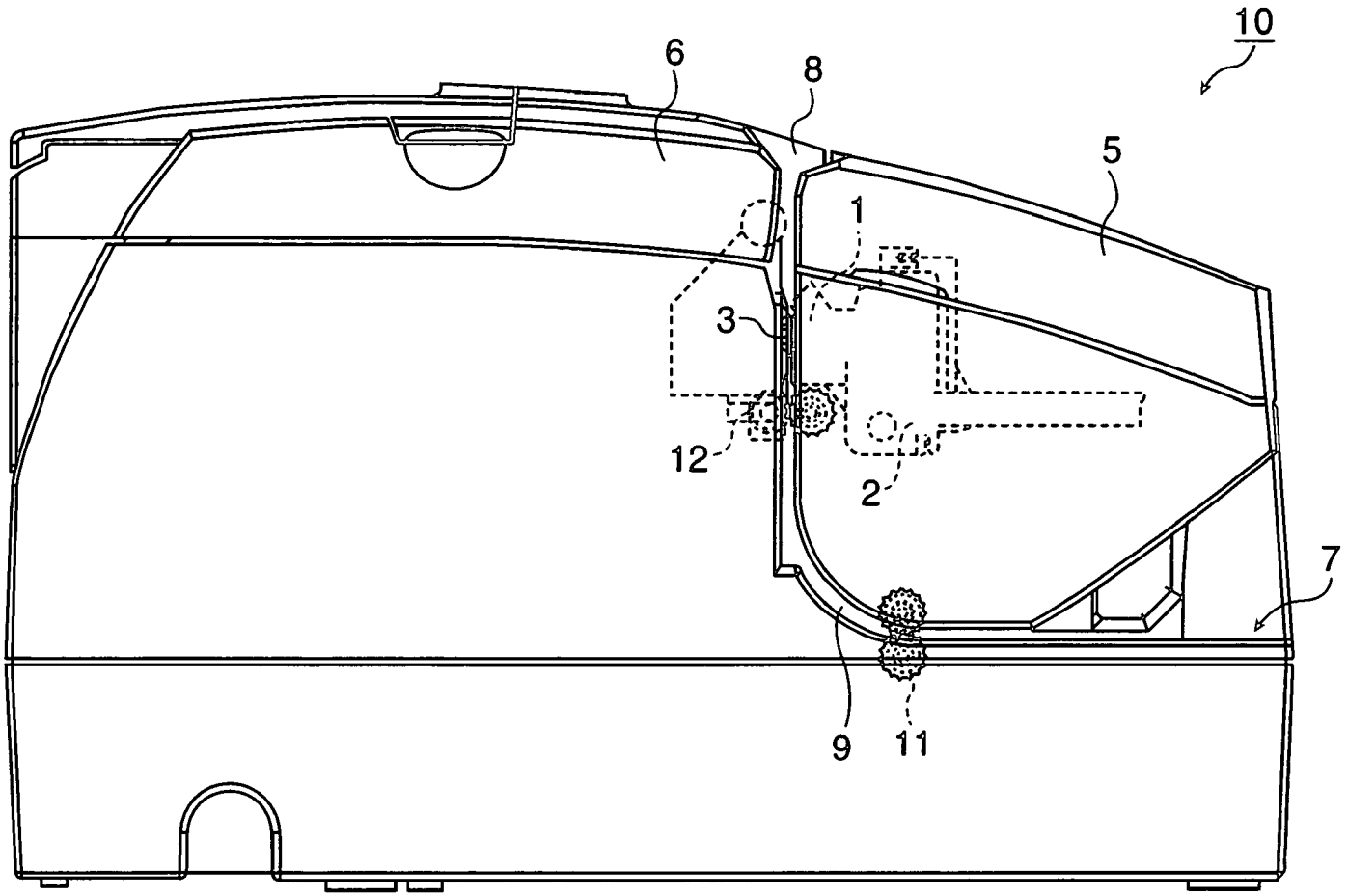
FIG. 1 is an external side view of a printing apparatus including a printer and a platen gap adjustment assembly according to a preferred embodiment of the invention.
Figure 5:
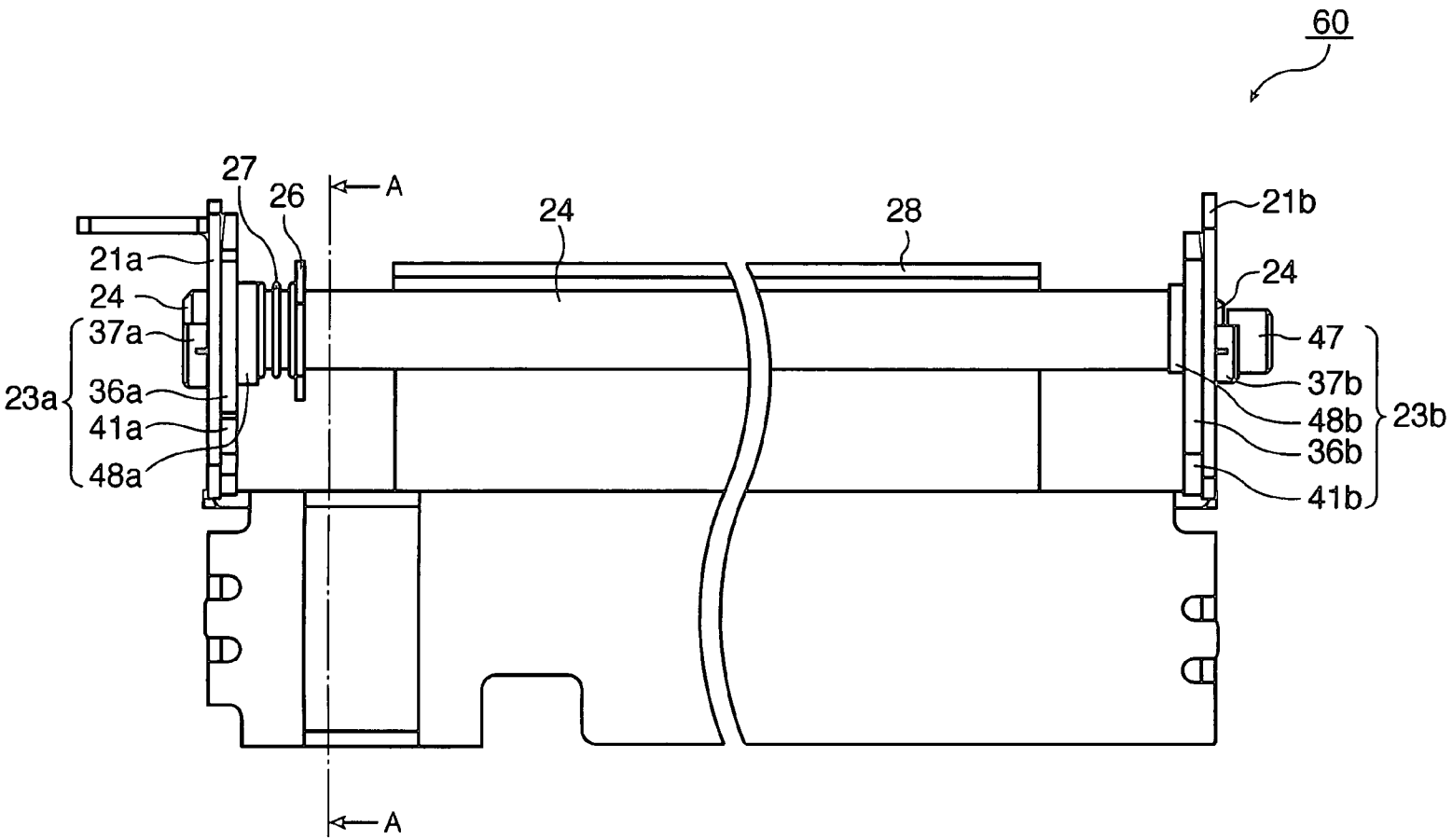
FIG. 5 is an external side view of the platen gap adjustment assembly.

The printing apparatus 10 as is shown in FIG. 1 comprises a printer 20 (shown in FIG. 2), a front case 5, a cover 6 and a platen gap adjustment assembly 60 (shown in FIG. 5). Print media, such as checks and slips, are inserted manually from an insertion opening 7 formed at the front of the printing apparatus 10. A discharge opening 8 is rendered at the top part of the cover 6 and a print media transportation path 9 connects the insertion opening 7 with the discharge opening 8. Transportation roller pairs 11 and 12, with each pair comprising two transportation rollers, are disposed to the transportation path 9. Print media inserted from the insertion opening 7 are conveyed by transportation roller pair 11 and transportation roller pair 12 along the transportation path 9 and are discharged from the discharge opening 8 at the top.

Figure 2:
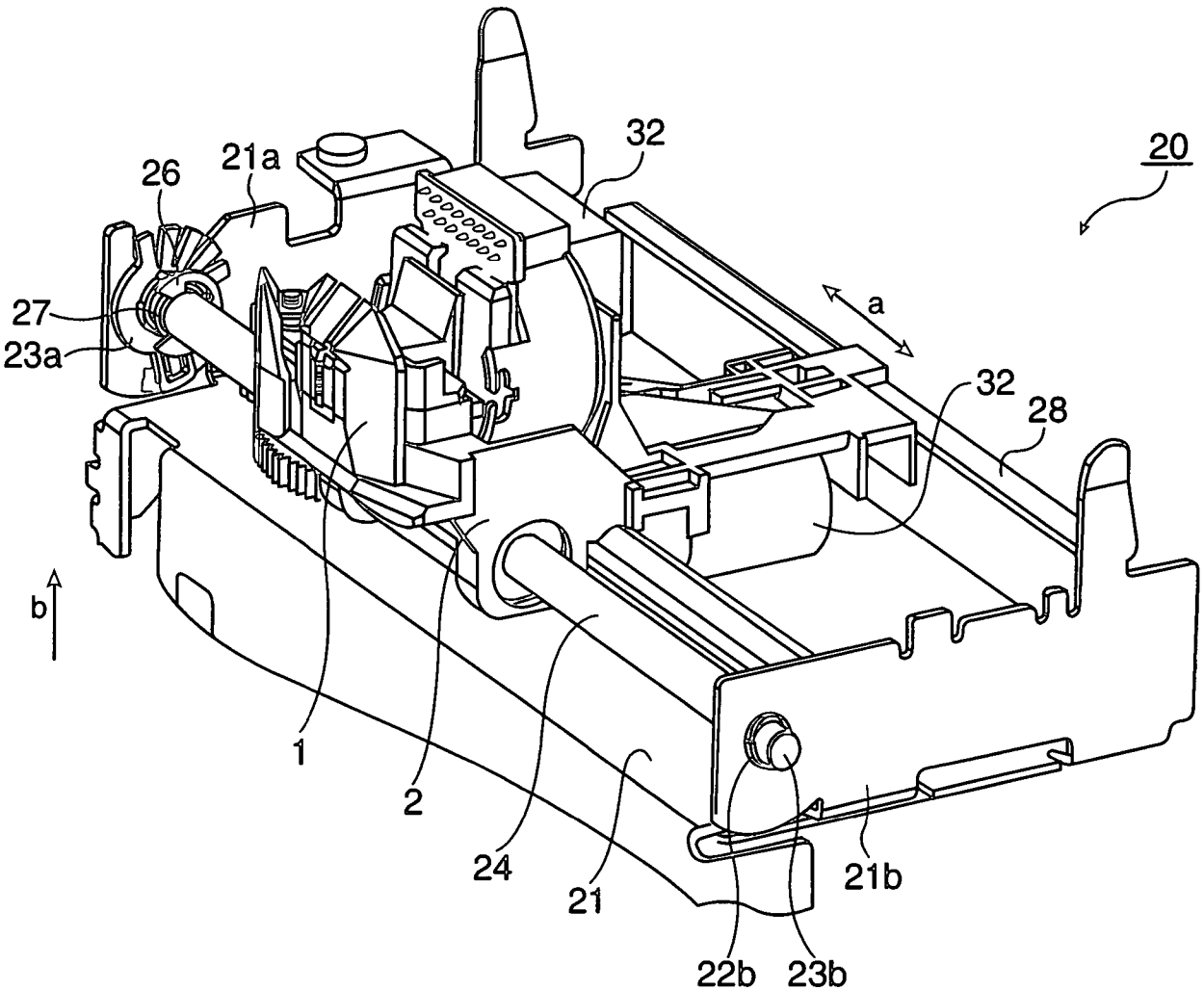
FIG. 2 is an external oblique view of the printer.

The printing apparatus 10 is disposed to the transportation path 9 with a print head 1 mounted on a carriage 2 that is supported so that the carriage 2 can slide on a printer frame 21 (shown in FIG. 2). A platen 3 is disposed opposite the print head 1 with the transportation path 9 therebetween. The distance between the platen 3 and print head 1 is the "platen gap."

A reading device (not shown) is also disposed to the transportation path 9. This reading device reads printed information recorded on the print medium passing through the transportation path 9. This reading device typically includes a scanner for reading printed barcodes and images, and a magnetic ink character reader (MICR) for reading magnetic ink characters printed with magnetic ink.

The printing apparatus 10 also has a roll paper compartment (not shown in the figure) towards the back of the hybrid system 10 for storing roll paper for receipt printing. After the roll paper is pulled from the roll paper compartment and printed, the roll paper is discharged from the roll paper exit rendered behind the discharge opening 8 in the top. The printing apparatus 10 is multifunctional. The arrangement for supporting the print head 1 in the printer 20 is described next. FIG. 2 is an external oblique view showing the major parts of the printer 20 comprising a print head 1, a printer frame 21 with a mounting hole 22*a* (see FIG. 8 and FIG. 9) and mounting hole 22*b*, respectively. The mounting holes 22*a* and 22*b* are formed in side walls 21 a and 21 b of the printer frame 21. Left mounting member 23*a* is fit into mounting hole 22*a*, and right mounting member 23*b* is fit into mounting hole 22*b*. The ends of the carriage shaft 24 are supported on the frame 21 by intervening left mounting member 23*a* and right mounting member 23*b*. An E-style retaining ring 26 is attached to the carriage shaft 24 near the left mounting member 23*a*, and a shaft spring 27 is loosely fit to the carriage shaft 24 between the left mounting member 23*a* and E-style retaining ring 26.

The left mounting member 23*a* corresponds to a first mounting member, the right mounting member 23*b* corresponds to the second mounting member, the shaft spring 27 corresponds to an urging member, and the carriage shaft 24 corresponds to the guide shaft in the accompanying claims of this invention.

Figure 3:
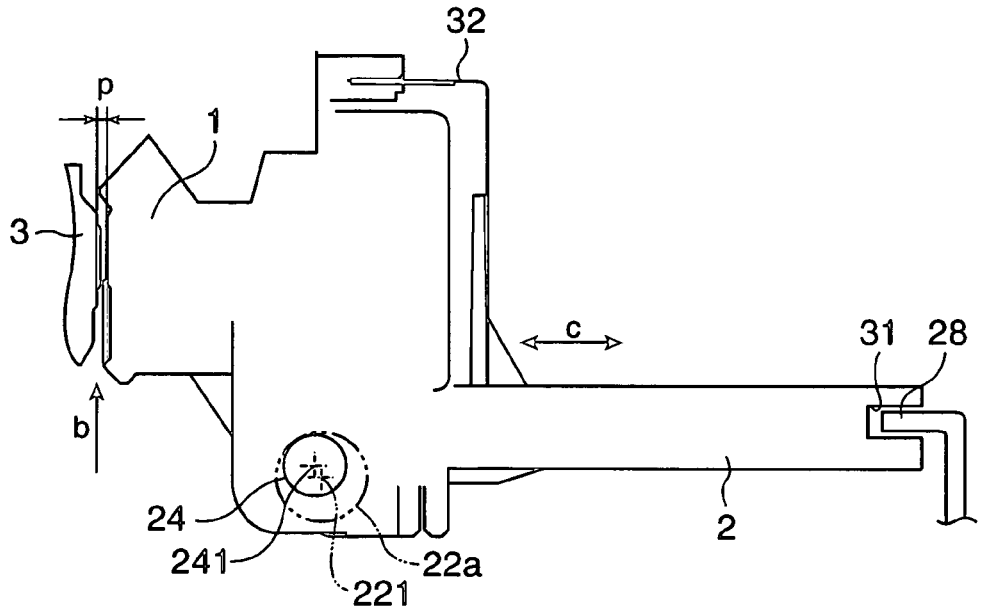
FIG. 3 is a schematic diagram showing the relative positions of the print head, the carriage shaft, and the platen in the printing apparatus of FIG. 1.

A carriage guide 28 parallel to the carriage shaft 24 is formed on the frame 21, and the carriage guide 28 fits into a guide channel 31 formed in the carriage 2 (see FIG. 3). One end of a flexible flat cable 32, which electrically connects the print head 1 to the print head 1 drive circuit (not shown in the figure), is connected to the print head 1, and the part of the flexible flat cable 32 near the print head 1 is fastened to the carriage 2. The carriage 2 slides bidirectionally in the direction of arrow a along the carriage shaft 24 and carriage guide 28. The print medium is conveyed in the direction of arrow b shown in FIG. 2.

The basics of platen gap adjustment are described next. FIG. 3 is a schematic diagram showing the relative positions of the print head 1 disposed perpendicularly to the carriage shaft 24 and the platen 3. As described above, the print head 1 and platen 3 are disposed opposite each other with the transportation path 9 therebetween. The gap p between the platen 3 and print head 1 in FIG. 3 is the platen gap. The carriage shaft 24 is mounted in the frame 21 and freely and slidably supports the carriage 2 inside bearing holes (not shown). A guide channel 31 fits onto the carriage guide 28 for limiting the position of the carriage shaft 24 in the circumferential direction. As described above, the ends of the carriage shaft 24 are supported on the frame 21 by means of the intervening left mounting member 23*a* and right mounting member 23*b*, and the left mounting member 23*a* and right mounting member 23*b* are fit into mounting hole 22*a* and mounting hole 22*b*, respectively.

As shown in FIG. 3, the center 241 of the carriage shaft 24 is not coaxial to the center 221 of the mounting hole 22*a* indicated by the double-dotted imaginary line in FIG. 3. The mounting hole center 221 is also not coaxial to the center of the other mounting hole 22*b*, not shown. As a result, when the left mounting member 23*a* is rotated around the shaft, the carriage shaft 24 rotates around mounting hole center 221, the carriage shaft center 241 also rotates around mounting hole center 221, and the position of the carriage shaft 24 moves. As the position of the carriage shaft 24 changes the print head 1 also moves in the direction of arrow c in FIG. 3, and the platen gap p can thus be adjusted.

The direction of arrow b perpendicular to arrow c in FIG. 3 is the same direction indicated by arrow b in FIG. 2. Movement of the print head 1 in this direction causes the printing position of the print head 1 to the print medium to shift, but this shift is small enough that it does not cause a problem. This offset can also be minimized by adjusting the printing start position of the print head 1 after adjusting the platen gap. Furthermore, if the position of the carriage shaft center 241 and the mounting hole center 221 in the direction indicated by arrow c are substantially the same after the platen gap is adjusted, movement of the carriage shaft 24 in the direction of arrow c will be greater and movement perpendicular to arrow c will be less.

Figure 4A:
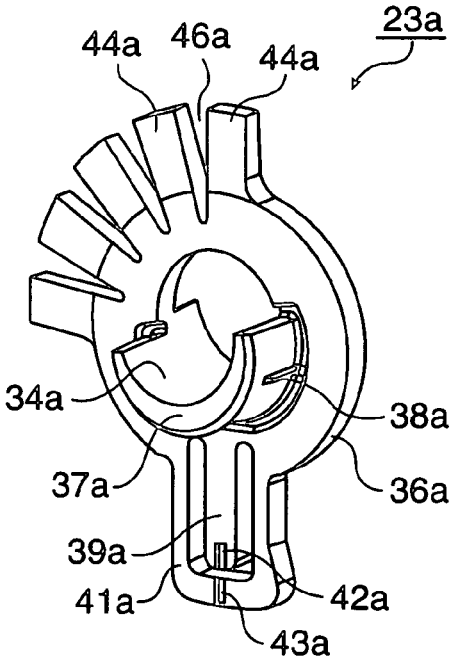
FIG. 4A is an oblique view of a left mounting member (before installation in the printer).
Figure 4B:
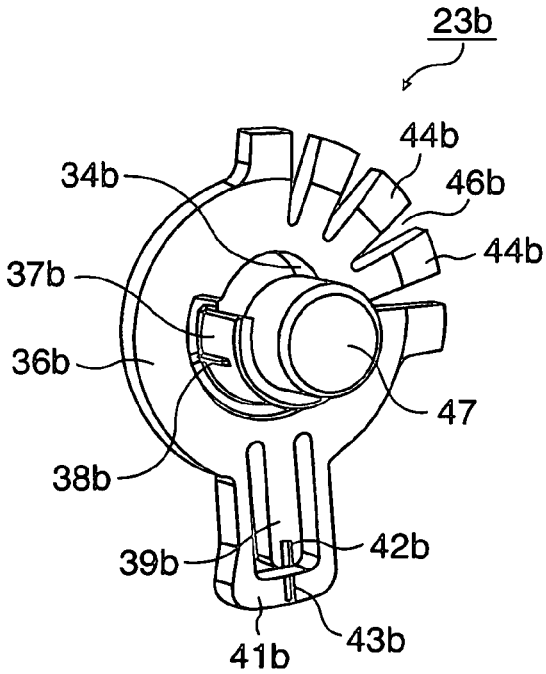
FIG. 4B is an oblique view of a right mounting member (before installation in the printer).

The arrangement of the left mounting member 23*a* and right mounting member 23*b* is described next. FIG. 4A is an oblique view of the left mounting member and FIG. 4B is an oblique view of the right mounting member. As shown in FIG. 4A, the left mounting member 23*a* has a disc-shaped mounting plate 36*a* having a circular carriage shaft hole 34*a* formed substantially in the center. A shoulder 37*a* having the shape of a partial cylinder is rendered projecting from one side of and in unison with the mounting plate 36*a*. Two ribs 38*a* (only one shown in FIG. 4) are formed on the outside surface of the shoulder 37*a* parallel to the axial direction of the shoulder 37*a*. The axis of the outside circumference of the carriage shaft hole 34*a* is parallel to and offset from the axis of a phantom cylinder in contact with the outside peaks of the two ribs 38*a*, and the outside circumference of the carriage shaft hole 34*a* is positioned contacting the inside surface of the phantom cylinder externally touching the peaks of the two ribs 38*a*. The carriage shaft 24 and frame 21 touch and are electrically connected near this internal contact part. As a result, the shoulder 37*a* is substantially semi-cylindrically shaped instead of cylindrically shaped. Furthermore, by electrically connecting the carriage shaft 24 and frame 21, electrostatic charges in the carriage shaft 24 can escape through the frame 21. Note that shoulder 37*a* and ribs 38*a* correspond to the first mounting shaft in the accompanying claims.

A cylindrical collar 48*a* (see FIG. 5 and FIG. 6) of which the center is the carriage shaft hole 34*a* is formed in unison with the mounting plate 36*a* on the side opposite the side of the mounting plate 36*a* on which the shoulder 37*a* is rendered. The collar 48*a* and carriage shaft hole 34*a* are coaxial.

Inside finger 39*a*, outside finger 41*a*, and five adjustment fingers 44*a* project from the outside circumference of the mounting plate 36*a*.

The inside finger 39*a* and outside finger 41*a* are divided by a substantially U-shaped channel into a substantially I-shaped inside finger 39*a* and a substantially U-shaped outside finger 41*a*. An inside detent 42*a* and an outside detent 43*a*, respectively, are formed in unison to the distal ends of the inside finger 39*a* and outside finger 41*a* projecting from the side in the same direction as the shoulder 37*a*.

The five adjustment fingers 44*a* are formed side by side in a radiating pattern, thus also forming adjustment slots 46*a* between adjacent adjustment fingers 44*a*.

The inside detent 42*a* and outside detent 43*a* correspond to the first positioning engagement parts, and the inside finger 39*a* and outside finger 41*a* correspond to the first engaging part arm, in the accompanying claims.

The right mounting member 23*b* is symmetric to the left mounting member 23*a* and additionally comprises a shaft-engaging part 47 as shown in FIG. 4B. More specifically, the right mounting member 23*b* comprises a carriage shaft hole 34*b*, mounting plate 36*b*, shoulder 37*b*, ribs 38*b*, inside finger 39*b*, outside finger 41*b*, inside detent 42*b*, outside detent 43*b*, adjustment fingers 44*b*, adjustment slots 46*b*, shaft-engaging part 47, and collar 48*b* (see FIG. 5 and FIG. 6). The shaft-engaging part 47 is rendered on the distal end side of the shoulder 37*b* so that the shaft-engaging part 47 contacts and stops a shaft fit inserted to the carriage shaft hole 34*b* from the collar 48*b* side of the mounting plate 36*b*.

The inside detent 42*b* and outside detent 43*b* correspond to the second positioning engagement parts, and the shoulder 37*b* and ribs 38*b* correspond to the second mounting shaft in the accompanying claims.

The arrangement for adjusting the platen gap is described next. FIG. 5 is an external side view of the platen gap adjustment assembly 60. As shown in FIG. 5, mounting hole 22*a* (FIG. 8 and FIG. 9) and mounting hole 22*b* (FIG. 2) are respectively formed in the side walls 21*a* and 21*b* of the frame 21. The shoulder 37*a* of left mounting member 23*a* is fit by intervening ribs 38*a* into mounting hole 22*a*, and the shoulder 37*b* of right mounting member 23*b* is fit by intervening ribs 38*b* into mounting hole 22*b*, so that the shoulders 37*a* and 37*b* can move rotationally around the axis. The ends of the carriage shaft 24 are fit into the carriage shaft hole 34*a* of left mounting member 23*a* and the carriage shaft hole 34*b* in right mounting member 23*b*, and the ends are thus supported on frame 21 by the intervening left mounting member 23*a* and right mounting member 23*b*.

A groove 242 (FIG. 9) is formed near the left mounting member 23*a* of the carriage shaft 24. The E-style retaining ring 26 fits into this groove 242. The shaft spring 27 is disposed loosely onto the carriage shaft 24 between the E-style retaining ring 26 and the collar 48*a* of the left mounting member 23*a*. The shaft spring 27 is a coil spring that works to push the collar 48*a* and E-style retaining ring 26 apart.

The shaft spring 27 in contact with the collar 48*a* pushes the left mounting member 23*a* against side wall 21*a*, thereby pressing the mounting plate 36*a*, inside detent 42*a*, outside detent 43*a*, and adjustment fingers 44*a* of the left mounting member 23*a* to the side wall 21*a*. The shaft spring 27 in contact with the E-style retaining ring 26 also pushes the carriage shaft 24 against the shaft-engaging part 47 of the right mounting member 23*b*, pushes the right mounting member 23*b* against the side wall 21*b*, and thus also pushes the mounting plate 36*b*, inside detent 42*b*, outside detent 43*b*, and adjustment fingers 44*b* of the right mounting member 23*b* against the side wall 21*b*.

Figure 6A:
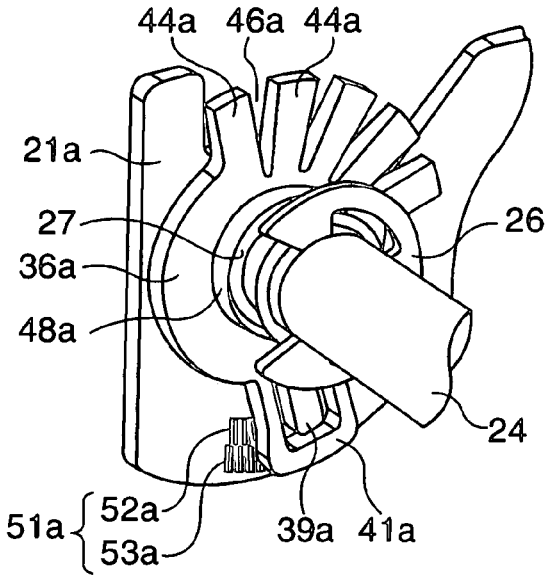
FIG. 6A is an oblique view showing the left mounting member (first mounting member) when installed.
Figure 6B:
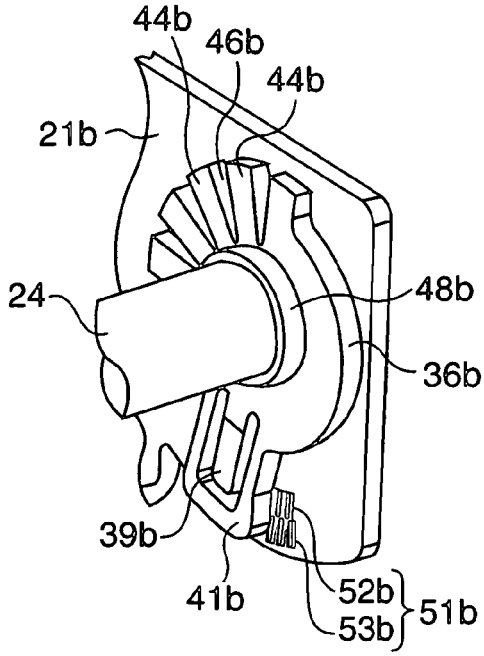
FIG. 6B shows the right mounting member (second mounting member) when installed.
Figure 7:
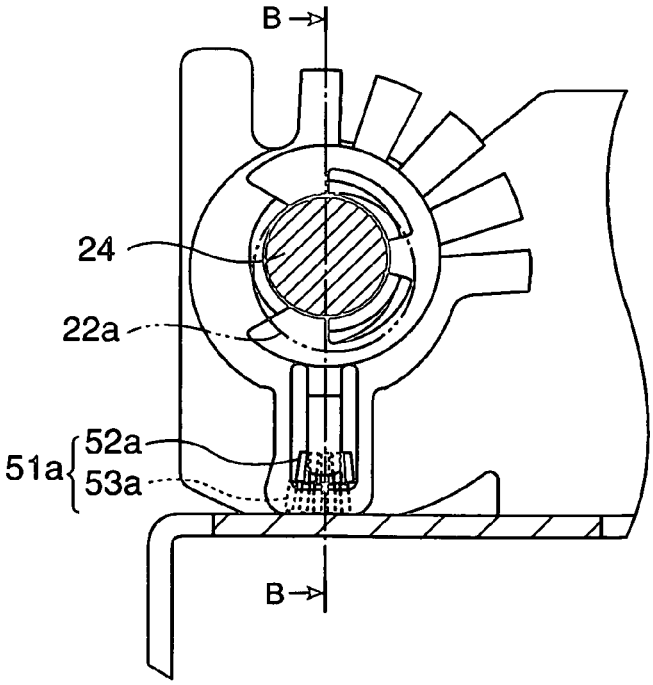
FIG. 7 is a section view through line A-A in FIG. 5.

FIG. 6A is an oblique view showing the left mounting member 23*a* (first mounting member) when installed, and FIG. 6B shows the right mounting member 23*b* (second mounting member) when installed. FIG. 7 is a section view through line A-A in FIG. 5.

As shown in FIG. 6A and FIG. 7, a series of detent grooves 51*a* including inside detent grooves 52*a* (first frame engaging parts) and outside detent grooves 53*a* (third frame engaging parts) are formed in the side wall 21*a*. The inside detent grooves 52*a* are rendered where they can engage the inside detent 42*a* (see FIG. 4A), and the outside detent grooves 53*a* are rendered where they can engage the outside detent 43*a*. Because the shoulder 37*a* is fit into the mounting hole 22*a* by intervening ribs 38*a* as described above, the left mounting member 23*a* is mounted to the side wall 21*a* so that the left mounting member 23*a* can rotate around the axis of the shoulder 37*a*. When the inside detent 42*a* and outside detent 43*a* are pressed to the side wall 21*a* and the left mounting member 23*a* rotates around the axis of the shoulder 37*a*, inside detent 42*a* or outside detent 43*a* is caught by one of the inside detent grooves 52*a* or outside detent grooves 53*a*, respectively. When inside detent 42*a* engages one of the inside detent grooves 52*a* or the outside detent 43*a* engages one of the outside detent grooves 53*a*, the position of the left mounting member 23*a* around the axis of the shoulder 37*a* is fixed, and the carriage shaft 24 is held in position to the side wall 21*a*.

Note that the inside detent grooves 52*a* and outside detent grooves 53*a* correspond to the first frame engaging parts and third frame engaging parts of the accompanying claims.

As shown in FIG. 6B, a series of detent grooves 51*b* including inside detent grooves 52*b* (second frame engaging parts) and outside detent grooves 53*b* (fourth frame engaging parts) are formed in the side wall 21 b. The inside detent grooves 52*b* are rendered where they can engage the inside detent 42*b*, and the outside detent grooves 53*b* are rendered where they can engage the outside detent 43*b*. Because the shoulder 37*b* is fit into the mounting hole 22*b* by intervening ribs 38*b* as described above, the right mounting member 23*b* is mounted to the side wall 21*b* so that the right mounting member 23*b* can rotate around the axis of the shoulder 37*b*. When the inside detent 42*b* and outside detent 43*b* are pressed to the side wall 21*b* and the right mounting member 23*b* rotates around the axis of the shoulder 37*b*, inside detent 42*b* or outside detent 43*b* is caught by one of the inside detent grooves 52*b* or outside detent grooves 53*b*, respectively. When inside detent 42*b* engages one of the inside detent grooves 52*b* or the outside detent 43*b* engages one of the outside detent grooves 53*b*, the position of the right mounting member 23*b* around the axis of the shoulder 37*b* is fixed, and the carriage shaft 24 is held in position to the side wall 21*b*.

Note that the inside detent grooves 52*b* and outside detent grooves 53*b* correspond to the second frame engaging parts and fourth frame engaging parts of the accompanying claims.

By thus securing both ends of the carriage shaft 24 to the side walls 21*a* and 21*b*, the carriage shaft 24 can be held in a desired position to the frame 21. As a result, a constant platen gap p, which is the distance between the print head 1 and platen 3 as shown in FIG. 3, can be held between the print head 1 mounted on the carriage 2 that is supported on the carriage shaft 24 and the platen 3 that is fixed in position on the frame 21 (see FIG. 2 and FIG. 3).

The detent grooves 51*a* and 51*b* are described in further detail below.

FIG. 8A is a plan view of the side wall through line A-A in FIG. 5. FIG. 8B is a section view of the inside detent grooves 52*a* as seen perpendicularly to the longitudinal axis of the inside detent grooves 52*a*. FIG. 8C is a section view of the outside detent grooves 53*a* as seen perpendicularly to the longitudinal axis of the outside detent grooves 53*a*.

As shown in FIG. 8A, five inside detent grooves 52*a* and five outside detent grooves 53*a* are formed on an arc centered on mounting hole center 221 of mounting hole 22*a*. The inside detent grooves 52*a* are formed on the arc passed by the inside detent 42*a* and the outside detent grooves 53*a* are similarly formed on the arc passed by the outside detent 43*a* when the left mounting member 23*a* inside the mounting hole 22*a* rotates.

The interval between adjacent inside detent grooves 52*a* and outside detent grooves 53*a* measured from the mounting hole center 221 is 3.4 degrees, for example. The row of inside detent grooves 52*a* is also offset one-half groove in the circumferential direction of the mounting hole center 221 from the row of outside detent grooves 53*a*. As a result, the inside detent grooves 52*a* and outside detent grooves 53*a* are offset 1.7 degrees from each other as measured from the mounting hole center 221. In order to reduce the area needed to render the detent grooves 51*a*, a row of inside detent grooves 52*a* is rendered adjacent to the inside circumference side of the outside detent grooves 53*a*. As a result, when the outside detent 43*a* is positioned where it engages one of the outside detent grooves 53*a* as shown in FIG. 8C, the inside detent 42*a* at the same circumferential position as the outside detent 43*a* is positioned where it will not engage the inside detent grooves 52*a* as shown in FIG. 8B.

Figure 9A:
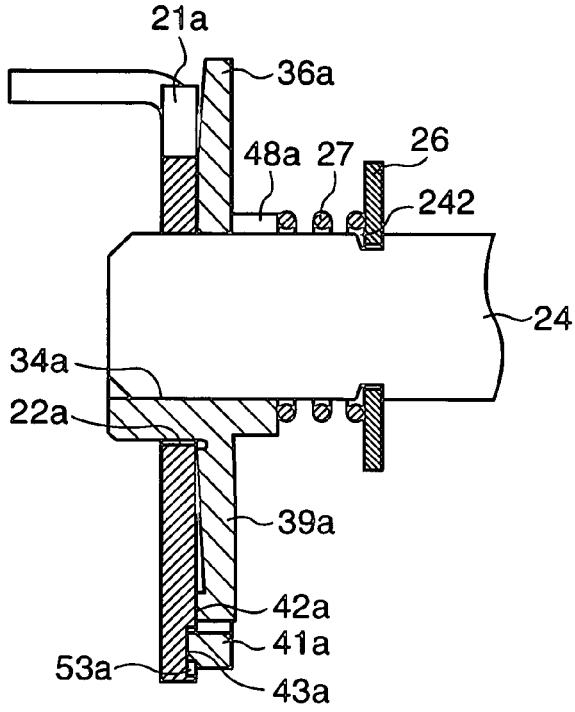
FIG. 9A is a section view through line B-B in FIG. 7 showing the outside detent engaged with an outside detent groove.
Figure 9B:
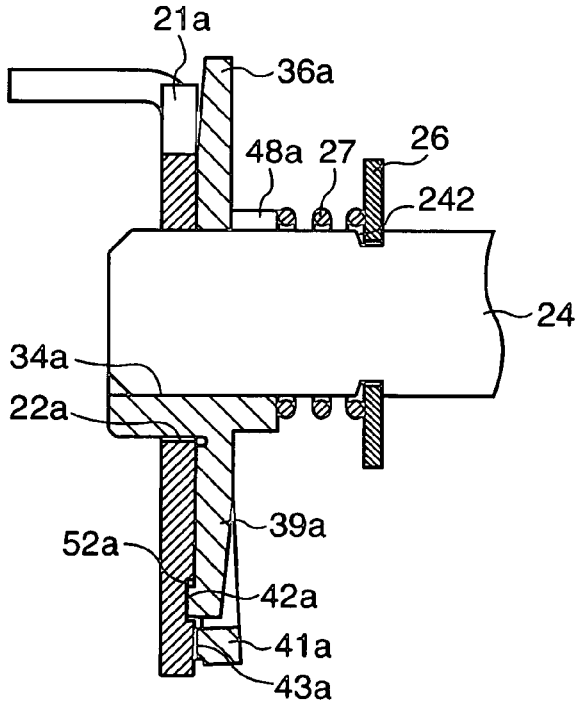
FIG. 9B is a section view through line B-B in FIG. 7 showing the inside detent engaged with an inside detent groove.

FIG. 9 is a section view through line B-B in FIG. 7 with FIG. 9A showing the outside detent 43*a* engaged with an outside detent groove 53*a*, and FIG. 9B showing the inside detent 42*a* engaged with an inside detent groove 52*a*. The relative positions of the inside detent 42*a* and outside detent 43*a* to the inside detent grooves 52*a* and outside detent grooves 53*a* shown in FIG. 9 are the same as the relative positions of the inside detent 42*a* and outside detent 43*a* to the inside detent grooves 52*a* and outside detent grooves 53*a* shown in FIG. 8B and FIG. 8C. When the outside detent 43*a* engages the outside detent grooves 53*a* as shown in FIG. 8C, the inside detent 42*a* is not positioned where it can engage the inside detent grooves 52*a* as shown in FIG. 8B. Instead, the inside finger 39*a* deforms and the inside detent 42*a* rides onto the surface of the side wall 21*a* as shown in FIG. 9A. When the left mounting member 23*a* rotates and the inside detent 42*a* enters an inside detent groove 52*a* as shown in FIG. 9B, the outside detent 43*a* is not positioned where it engages an outside detent groove 53*a*, and instead the outside finger 41*a* deforms so that the outside detent 43*a* rides onto the surface of the side wall 21*a*.

The resistance of the inside finger 39*a* or outside finger 41*a* deformed perpendicularly to the surface of the side wall 21*a* when the inside detent 42*a* or outside detent 43*a* rides onto the surface of the side wall 21*a* is less than the urging force of the shaft spring 27. The deformation resistance when the inside finger 39*a* or outside finger 41*a* deforms perpendicularly to the surface of the side wall 21*a* works in the direction separating the left mounting member 23*a* from the side wall 21*a*, but because the urging force of the shaft spring 27 is greater than this deformation force, the left mounting member 23*a* is held pressed against the side wall 21*a*.

When the outside detent 43*a* engages one of the outside detent grooves 53*a*, or the inside detent 42*a* engages one of the inside detent grooves 52*a*, the left mounting member 23*a* is held so that it cannot turn. As a result, the left mounting member 23*a* can be adjusted and held at intervals of a 1.7 degree angle of rotation. The change in the platen gap p corresponding to this 1.7 degree angle of rotation in the left mounting member 23*a* is the adjustment unit of the platen gap p.

In order to rotate the left mounting member 23*a* in the circumferential direction of the shoulder 37*a*, the tip of a flat screwdriver, for example, is inserted to an adjustment slot 46*a* and manipulated. As shown in FIG. 8B and FIG. 8C, the detent grooves 51*a* have a substantially triangular section in the circumferential direction of the shoulder 37*a*. The sloped sides of the detent grooves 51*a* contact and thus engage the sloping sides of the outside detent 43*a* or inside detent 42*a*, and thereby prevent rotation in the circumferential direction of the shoulder 37*a* of left mounting member 23*a*. When the flat screwdriver, for example, is inserted to an adjustment slot 46*a* and manipulated to apply a force greater than the deformation resistance of the inside finger 39*a* or outside finger 41*a* perpendicular to the surface of the side wall 21*a*, the inside detent 42*a* or outside detent 43*a* disengages the detent grooves 51*a* and permits the left mounting member 23*a* to move circularly in the circumferential direction of the shoulder 37*a*.

In order to support the print head 1 stably and not be affected by vibrations from the carriage 2 sliding or the print head 1 being driven, engagement of the shoulder 37*a* with the mounting hole 22*a* by intervening ribs 38*a* is preferably not easily displaced. The dimensions of the left mounting member 23*a*, mounting hole 22*a*, and carriage shaft 24 are therefore set to permit movement as described above while preventing unwanted displacement due to such vibrations from normal operation, for example.

The detent grooves 51*b* rendered on side wall 21*b* are surface symmetrical to the detent grooves 51*a*, and the end of the carriage shaft 24 supported by the right mounting member 23*b* can be adjusted and held in the same way as the end supported by the left mounting member 23*a*.

The invention thus described has the following effects.

(1) When the inside finger 39*a* or outside finger 41*a* of the side wall 21*a* urged by the shaft spring 27 engages one of the inside detent grooves 52*a* or outside detent grooves 53*a* (detent grooves 51*a*), this engagement is held by the urging force of the shaft spring 27. When the inside detent 42*b* or outside detent 43*b* of the right mounting member 23*b*, which is pressed by the shaft-engaging part 47 as a result of the shaft spring 27 pushing the carriage shaft 24 against the shaft-engaging part 47, engages one of the inside detent grooves 52*b* or outside detent grooves 53*b* (detent grooves 51*b*), this engagement is held by the urging force of the shaft spring 27. The urging force of the shaft spring 27 thus keeps inside finger 39*a* or outside finger 41*a* engaged with detent grooves 51*a*, keeps inside finger 39*b* or outside finger 41*b* engaged with detent grooves 51*b*, and thus holds the shoulder 37*a* and shoulder 37*b* of the carriage shaft 24 in a specific position in the circumferential direction.

Because the deformation resistance of the part engaging the shoulder 37*a* with inside finger 39*a* or outside finger 41*a* or the part engaging the shoulder 37*b* with inside finger 39*b* or outside finger 41*b* holds these parts engaged with each other, greater force sufficient to further elastically deform these engaging parts is not needed. The left mounting member 23*a* and right mounting member 23*b* can thus be rendered compactly, and the platen gap adjustment device can be reduced in size.

(2) An inside detent 42*a* and outside detent 43*a* are rendered at the same position in the circumferential direction, and matching inside detent grooves 52*a* and outside detent grooves 53*a* that can engage the corresponding detents 42*a* and 43*a* are also rendered. The inside detent grooves 52*a* and outside detent grooves 53*a* are disposed with a gap of 3.4 degrees referenced to the mounting hole center 221 between adjacent grooves. The inside detent grooves 52*a* and outside detent grooves 53*a* are also offset one-half groove interval in the circumferential direction around the mounting hole center 221. This enables rotating and holding the left mounting member 23*a* in 1.7 degree increments.

(3) The friction resistance of the fitting between the carriage and carriage shaft also applies force to the carriage shaft in the direction in which the carriage moves. In an arrangement in which the carriage shaft can move slightly in the axial direction, the carriage shaft can move in conjunction with carriage movement, and the carriage can also slide on the carriage shaft. Because the moving mass and the magnitude of the sliding resistance differ in these two situations, the operating characteristics at the start of carriage operation are also different in these two situations. The moving mass and the magnitude of the sliding resistance also change when the carriage shaft that was moving with the carriage stops moving after moving the slight distance that the carriage shaft can move. This can result in inconsistent movement of the carriage.

The shaft spring 27 is compressed between the collar 48*a* and E-style retaining ring 26, and thus pushes the collar 48*a* and E-style retaining ring 26 apart. The carriage shaft 24 is urged by the shaft spring 27 in contact with the E-style retaining ring 26 so that the carriage shaft 24 contacts the shaft-engaging part 47 of the right mounting member 23*b*, thereby limiting movement of the carriage shaft 24 in the axial direction. This also limits change in the moving mass and sliding resistance when the carriage 2 moves along the carriage shaft 24.

(4) The mounting members can be easily released and rotated to adjust the platen gap by inserting a flat screwdriver, for example, into adjustment slots rendered in the mounting members. It is therefore not necessary to provide a lever for rotating the mounting members on the mounting members, and the size of the mounting members can therefore be reduced.

(5) The shaft spring 27 is a compressed coil spring that fits loosely on the carriage shaft 24. The space needed to dispose the shaft spring 27 to the carriage shaft 24 is therefore small and limited to a space approximately equal to the wire diameter of the shaft spring 27.

The invention is not limited to the preferred embodiments described above and can be varied in many ways without departing from the scope of the accompanying. A few of these variations are described below.

Variation 1

Detents are formed on the distal ends of finger-like projections extending from the outside circumference of the mounting members, and these detents can be displaced relative to the mounting members, but it is not necessary for the detents to be displaceable to the mounting members. The detents can alternatively be rendered directly on the surface of the mounting members. This eliminates the possibility of the fingers becoming deformed between the mounting members and the detents, and thus affords more positive engagement than when projecting fingers are used. The plural detents cannot be individually displaced from the mounting member in this arrangement, and a plurality of detents therefore engage the detent grooves at the same time.

Variation 2

The inside finger 39*a* and outside finger 41*a* are formed from the outside circumference of the mounting plate 36*a* as a linear extension of the mounting plate 36*a* in the embodiment described above, but the inside finger 39*a* and outside finger 41*a* could be formed curving towards the side wall 21*a*. By curving the inside finger 39*a* and outside finger 41*a* toward the side wall 21*a*, the inside detent 42*a* and outside detent 43*a* more easily touch the side wall 21*a* when the left mounting member 23*a* is disposed to the side wall 21*a*, and the inside detent 42*a* and outside detent 43*a* thus more positively engage the detent grooves 51*a*.

Variation 3

A coil compression spring is used as the urging member in the embodiment described above, but a torsion spring could be used instead. Using a torsion spring enables shortening the length of the urging member in the axial direction of the carriage shaft.

Variation 4

Adjustment slots are formed in the above embodiment by forming adjustment fingers projecting from the mounting member, but the adjustment slots could be rendered directly in the mounting member without forming the adjustment fingers.

Variation 5

The inside detent 42*a* and outside detent 43*a* are located at the same circumferential position, and the inside detent grooves 52*a* and outside detent grooves 53*a* are rendered offset half of the groove interval from each other along a circumferential arc centered on mounting hole center 221. The same effect can be achieved, however, by rendering the inside detent grooves 52*a* and outside detent grooves 53*a* at the same circumferential position, and offsetting the positions of the inside detent 42*a* and the outside detent 43*a* by half of the groove interval.

Variation 6

Engaging parts, specifically inside detent 42*a* and outside detent 43*a*, are rendered in two locations as positioning engagement parts in the above embodiment, but the positioning engagement parts are not limited to two locations. The mounting member can be rotated and held in smaller angular increments by increasing the number of engagement parts at offset positions. Furthermore, by simultaneously engaging a plurality of engagement parts, the mounting members can be held more positively in position than is possible using only one engagement part.

Variation 7

The detent grooves 51*a* and 51*b* and the detents have a substantially triangular section in the above embodiment and engage with surfaces inclined to the direction in which the left or right mounting member rotates. The shape of these grooves and detents in section is not limited to substantially triangular, however. The detent grooves and matching detents could be substantially rectangular in section, for example, and could mate with surfaces perpendicular to the direction in which the mounting members rotate. By thus engaging surfaces that are perpendicular to the direction in which the mounting members rotate, the mating surfaces are less likely to disengage accidentally, and the mounting members and platen gap can be held more positively in position.

Adjusting the platen gap may seem to be made more difficult if the engaging surfaces disengage more difficultly, but this is not a problem in the present invention because the left mounting member 23*a* or right mounting member 23*b* can be easily disengaged by pressing on the shoulder 37*a* or shaft-engaging part 47.

Variation 8

The left mounting member 23*a* and right mounting member 23*b* are surface symmetrical in the above embodiment, but are not necessarily symmetrical. The effect of the invention is not impaired if the mounting members are configured according to the shape of the parts disposed around them.

Variation 9

The length of the inside fingers 39*a* and 39*b* is different from the length of the outside fingers 41*a* and 41*b* so that the inside detents 42*a* and 42*b* are radially offset from the outside detents 43*a* and 43*b* and a plurality of detents can be rendered at different positions in the radial direction. The same effect can be achieved by shifting the positions in the circumferential direction, however, by forming fingers of the same length at different positions in the circumferential direction and rendering the detents on substantially the same circumferential arc.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A platen gap adjustment assembly for adjusting the spacing between a platen and a print head in a printing apparatus that prints to a print medium comprising:

a carriage movably supported on a frame having spaced apart opposing sides with a first mounting hole disposed on one side of the frame and a second mounting hole symmetrically disposed on the opposite side of the frame;

a first mounting member adapted to fit into said first mounting hole for forming a first shaft hole;

a second mounting member adapted to fit into said second mounting hole for forming a second shaft hole;

a guide shaft extending between said first shaft hole and said second shaft hole for slidably supporting bidirectional movement of said carriage between said opposing sides of the frame, with said carriage carrying said print head;

wherein said first shaft hole is formed by said first mounting member to render said first shaft hole eccentric to said guide shaft and to enable the first mounting member to rotate around the guide shaft with said first mounting member having first positioning engagement part(s) for positioning said first mounting member into a selected fixed position relative to one side of said frame;

wherein said second shaft hole is formed by said second mounting member to render said second shaft hole eccentric to said guide shaft and to enable the second mounting member to rotate around the guide shaft with said second mounting member having second positioning engagement part(s) for positioning said second mounting member into a selected fixed position relative to the opposite side of said frame; and an urging member for urging the first and/or second positioning engagement part(s) into engagement with the frame on either or both sides respectively.

2. The platen gap adjustment assembly as described in claim 1, wherein said frame further comprises a plurality of frame engaging parts including a first frame engaging part and a second frame engaging part for engaging the first and second positioning engagement part(s) of said mounting members to selectively position the mounting members to the frame for adjusting the platen gap; and wherein said urging member urges the first and second positioning engagement parts into an engagement position with frame engaging parts.

3. The platen gap adjustment assembly described in claim 2 wherein:

the first mounting member comprises a plurality of first engaging part arms projecting from the first mounting shaft and having the first positioning engagement part(s) rendered on the distal end thereof;

the second mounting member comprises a plurality of second engaging part arms projecting from the second mounting shaft and having the second positioning engagement part(s) rendered on the distal end thereof;

the frame comprises a plurality of third frame engaging parts for engaging the first positioning engagement part(s), and a plurality of fourth frame engaging parts for engaging the second positioning engagement part(s);

the third frame engaging part(s) is formed at a position where when the first positioning engagement part(s) formed on one of the first engaging part arms is engaged with one of the third frame engaging parts, the first positioning engagement part(s) formed on the other first engaging part arm is not engaged with the third frame engaging part; and the fourth frame engaging part(s) is formed at a position where when the second positioning engagement part(s) formed on one of the second engaging part arms is engaged with one of the fourth frame engaging parts, the second positioning engagement part(s) formed on the other second engaging part arm is not engaged with the fourth frame engaging part(s).

4. The platen gap adjustment assembly described in claim 3, wherein:

the length of one first engaging part arm is different from the length of the other first engaging part arm; and the length of one second engaging part arm is different from the length of the other second engaging part arm.

5. The platen gap adjustment assembly described in claim 4 wherein:

when the first positioning engagement part(s) formed on one of the first engaging part arms is not engaged with the first frame engaging part(s), the first positioning engagement part(s) formed on the other first engaging part arm engages one of the third frame engaging parts; and when the first positioning engagement part(s) formed on one of the first engaging part arms is engaged with one of the first frame engaging parts, the first positioning engagement part(s) formed on the other first engaging part arm does not engage the third frame engaging part(s).

6. The platen gap adjustment assembly described in claim 3 wherein:

when the first positioning engagement part(s) formed on one of the first engaging part arms is not engaged with the first frame engaging part(s), the first positioning engagement part formed on the other first engaging part arm engages one of the third frame engaging parts; and when the first positioning engagement part(s) formed on one of the first engaging part arms is engaged with one of the first frame engaging parts, the first positioning engagement part(s) formed on the other first engaging part arm does not engage the third frame engaging part(s).

7. The platen gap adjustment assembly described in claim 3 wherein:

when the second positioning engagement part(s) formed on one of the second engaging part arms is not engaged with the second frame engaging part(s), the second positioning engagement part(s) formed on the other second engaging part arm engages one of the fourth frame engaging parts; and when the second positioning engagement part(s) formed on one of the second engaging part arms is engaged with one of the second frame engaging parts, the second positioning engagement part(s) formed on the other second engaging part arm does not engage the fourth frame engaging part(s).

8. The platen gap adjustment assembly described in claim 4 wherein:

when the second positioning engagement part(s) formed on one of the second engaging part arms is not engaged with the second frame engaging part(s), the second positioning engagement part(s) formed on the other second engaging part arm engages one of the fourth frame engaging parts; and when the second positioning engagement part(s) formed on one of the second engaging part arms is engaged with one of the second frame engaging parts, the second positioning engagement part formed on the other second engaging part arm does not engage the fourth frame engaging part(s).

9. The platen gap adjustment assembly described in claim 2 wherein said urging member is a coil spring.

* * * * *